US009505106B2

(12) United States Patent
Neiss et al.

(10) Patent No.: US 9,505,106 B2
(45) Date of Patent: Nov. 29, 2016

(54) METHOD FOR ROTATING A ROTATABLE PART

(75) Inventors: Günter Neiss, Alfter (DE); Bernd Linsel, Kreuztal (DE); Günter Andres, Much (DE); Andreas Zimmer, Troisdorf (DE)

(73) Assignee: WAGNER VERMÖGENSVERWALTUNGS GMBH & CO. KG, Much (DE)

( * ) Notice: Subject to any disclaimer, the term of this patent is extended or adjusted under 35 U.S.C. 154(b) by 462 days.

(21) Appl. No.: 14/005,180

(22) PCT Filed: Mar. 6, 2012

(86) PCT No.: PCT/EP2012/053797
§ 371 (c)(1),
(2), (4) Date: Feb. 4, 2014

(87) PCT Pub. No.: WO2012/123284
PCT Pub. Date: Sep. 20, 2012

(65) Prior Publication Data

US 2014/0165790 A1 Jun. 19, 2014

(30) Foreign Application Priority Data

Mar. 14, 2011 (DE) ..... 10 2011 013 926

(51) Int. Cl.
*B25B 21/00* (2006.01)
*B25B 23/145* (2006.01)
*F15B 15/06* (2006.01)

(52) U.S. Cl.
CPC ..... *B25B 21/005* (2013.01); *B25B 23/1456* (2013.01); *F15B 15/061* (2013.01)

(58) Field of Classification Search
CPC ... B25B 21/00; B25B 21/005; B25B 23/145; B25B 23/1456; B25B 15/061
USPC ..... 81/57.39, 470
See application file for complete search history.

(56) References Cited

U.S. PATENT DOCUMENTS

| | | | | |
|---|---|---|---|---|
| 4,941,362 | A * | 7/1990 | Tambini | B25B 23/145 73/862.23 |
| 6,112,622 | A * | 9/2000 | Reiman | B25B 21/005 81/57.39 |
| 6,311,585 | B1 * | 11/2001 | Jamra | B25B 21/005 81/57.39 |
| 6,532,845 | B1 * | 3/2003 | Reiman | B25B 21/005 81/57.39 |
| 2005/0210872 | A1 * | 9/2005 | Wagner | B25B 21/005 60/431 |
| 2009/0000397 | A1 * | 1/2009 | Wagner | B25B 23/145 73/862.23 |

FOREIGN PATENT DOCUMENTS

| | | |
|---|---|---|
| DE | 102 22 159 A1 | 11/2003 |
| GB | 2 449 638 A | 12/2008 |
| WO | 03/013797 A1 | 2/2003 |

OTHER PUBLICATIONS

International Search Report dated May 7, 2012, as issued in corresponding International Patent Application No. PCT/EP2012/053797 (2 pages).

* cited by examiner

*Primary Examiner* — Hadi Shakeri
(74) *Attorney, Agent, or Firm* — Maier & Maier, PLLC

(57) ABSTRACT

A method for rotating a rotatable part using a hydraulic piston-cylinder drive operated by a hydraulic pressure source and having at least one piston and a ratchet, wherein a torque is applied to the rotatable part during a loading stroke and the piston is moved into a starting position via a return stroke. The loading stroke ends when an end position of the piston is reached and subsequently the return stroke is started, wherein the end position is a position of the piston before the piston abuts against an end stop.

10 Claims, 1 Drawing Sheet

METHOD FOR ROTATING A ROTATABLE PART

BACKGROUND

A. Field

The invention relates to a method for rotating a rotatable part by use of a hydraulic piston-cylinder drive operated by a hydraulic pressure source and having at least one piston as well as a hydraulic cylinder and a ratchet, wherein a torque is applied to the rotatable part during a loading stroke and the piston is moved into a starting position via a return stroke.

B. Related Art

Methods for rotating a rotatable part are known particularly for operation of hydraulic power wrenches.

In practice, hydraulic power wrenches are operated primarily by two methods, the so-called torque method and the so-called torque/torque-angle method. Both methods include a method step in which a defined torque is applied on the part which is to be rotated.

For measuring the torque applied onto the to-be-rotated part, it is known to provide a torque sensor. Such a method is already known from WO 03/013797 A1. The provision of added torque sensors causes additional expenditure and has the consequence that only certain types of power wrenches are suited for practicing the method. Further, such sensors are arranged on the power wrench itself, thus rendering the device sensitive to contamination and environmental influences. Since power wrenches are frequently used on construction sites, this sensitivity to environmental influences and contamination is considered to be highly disadvantageous.

Further, it is known to detect pressure data of the pressure source that is feeding the piston-cylinder unit of a power wrench, and to conclude from these data on the torque applied to the part which is to be rotated. For this purpose, on the basis of the known geometry of the power wrench, the pressure that the pressure source exerts onto the piston of the piston-cylinder unit is converted into a torque.

It is known, for instance, to control such power wrenches manually in that, for the pressure source, a maximum pressure is preset which corresponds to the desired torque. In the process, the operator has to initiate the advance and return strokes manually. In such a method, however, the system cannot detect whether the pressure exerted by the pressure source is really applied as a torque on the to-be-rotated part. It may happen that the piston of the piston-cylinder unit has abutted against an end stop and the pressure source is increasing the pressure still further. For this reason, this method generally necessitated a visual check on the side of the operating personnel for detecting whether, when the preset end pressure was reached, there had beforehand occurred a rotary movement of the to-be-rotated part. Particularly in very large power wrenches wherein a very slow angular speed of the to-be-rotated part is generated, such a visual check can be performed only with considerable difficulty.

In modern power wrench systems, the power wrenches are automatically controlled by a control device wherein, as soon as the pressure corresponding to the desired torque is reached, the pressure source will be automatically switched off or a phase of angle-controlled rotation will be initiated.

In the process, the control device cannot detect a situation where the exerted pressure is being applied merely on an end stop and there does not occur a transmission of the pressure to the rotatable part. As a consequence, also such an automatic control makes it necessary for the operator to carry out a visual check.

Thus, there are known various control methods for hydraulic power wrenches wherein an automatic control of the pressure source is provided. DE 102 22 159 A1, for instance, describes a method wherein the temporal development of the pressure of the pressure source is evaluated. From the change of the gradients of the pressure development, there are obtained signals for returning the piston-cylinder unit and for terminating the process. The process of torque application will be terminated as soon as it has been verified that the desired torque has really been impressed on the fastening element. The advantage of this method resides in that no sensorics is required on the hydraulic wrench itself since the pressure signals can be measured directly in the pressure source. In this method, the problem exists that the gradient change between the gradient of the pressure during pressure build-up at the start of the stroke, i.e. at a time when no rotation of the to-be-rotated part is occurring yet, the gradient of the pressure during the rotating movement, and the gradient of the pressure after abutment of the piston on an end stop at the end of the load stroke, are massively influenced by the volume of the piston-cylinder unit and the volume of the hydraulic tube which connects the pressure source to the hydraulic wrench. Since particularly the gradient change between the gradient of the pressure during the rotating movement, and the gradient of the pressure after abutment of the piston at the end of the load stroke is of interest because it has to be detected which torque has really been impressed on the rotatable part prior to the abutment of the piston onto the end stop, this method allows for a reliable control only if the pressure development during the gradient change includes a discontinuity. Particularly in case of large tools and weak pressure sources, the pressure development of a gradient change can show a steady development so that a precise detection of the torque applied to the rotatable part prior to the abutment of the piston onto the end stop will not be possible at all or only with difficulties.

Further, even in identical systems, i.e. identical tube lengths and identical volumes of the piston-cylinder units, the gradients which are to be evaluated will be influenced by parameters of the to-be-rotated parts, so that a pressure-gradient-based control of the pressure source may happen to react in an ambiguous manner in different applications.

SUMMARY OF THE DISCLOSURE

Thus, it is an object of the present invention to provide a method for rotating a rotatable part using a hydraulic piston-cylinder drive and a ratchet, in which method—independently from the system components used and without using additional torque sensors—it is guaranteed that, when the pressure source is switched off as soon as a pressure corresponding to the desired end torque has been reached, the end torque has really been imparted on the part which is to be rotated.

The method of the invention is characterized in that the loading stroke will be terminated when an end position is reached and, subsequently, the return stroke will be started, the end position being a position of the piston before the piston will abut against an end stop. In this manner, it can be guaranteed that, via the piston-cylinder drive and the ratchet, the pressure exerted by the pressure source will always be transmitted onto the rotatable part in form of a torque. Thus, when a predetermined pressure is reached that is determined by the already known system component or by a preceding calibration, the control of the hydraulic pressure source can be switched off, and it is safeguarded that this pressure really has been imparted onto the rotatable part in the form of a torque. By the fact that the load stroke will be terminated when the piston has not yet abutted against the end stop, it is guaranteed that the pressure generated by the pressure source has resulted from the increased torque resistance of the rotatable part and not from the abutment of the piston against the end stop. In other words, the pressure would be transmitted to the rotatable part and not to the end stop of the piston.

The method of the invention makes it possible to control the hydraulic pressure source in a simplified manner because the problematics caused by reaching the end stop of the piston does not exist.

Since, during the load stroke, very high pressures are built up by the pressure source, which upon abutment of the piston on the end stop will cause a high mechanical stress of the piston-cylinder drive, the method of the invention is suited to avoid this mechanical stress during operation of the piston-cylinder drive, resulting in a longer operating life of the piston-cylinder drive. The method of the invention allows for a control which is independent from the real temporal development of the pressure during a load stroke. Thus, such a control will not be influenced by unpredictable changes of the pressure gradient which may occur during the rotating of a rotatable part in the load stroke, e.g. by residual distances, setting, scuffing, or changes of the friction values. The reliability of the control is thus increased.

The return stroke can be performed either by pressurizing the piston through a hydraulic liquid, or by means of a resetting element such as e.g. a spring.

In the context of the invention, a ratchet is generally to be understood as an element for force and respectively torque transmission which in one direction is freely rotatable and in the opposite direction will transmit the force or torque by force- or form-locked engagement.

In the method of the invention, it can be provided that a current position of the piston is determined during the load stroke. By determining the current position of the piston on the basis of the travel path of the piston, it is rendered possible in a simple manner to detect the arrival at the end position of the piston and to terminate the load stroke. The determining of the position can be done continuously or in time intervals. According to a preferred embodiment of the invention, the travel path during the load stroke is determined on the basis of the volume of the hydraulic fluid supplied to the hydraulic cylinder. This is performed by converting the volume and the known geometry of the hydraulic cylinder into the travel path.

In the above context, it can be provided that the volume of the hydraulic fluid supplied to the hydraulic cylinder during the return stroke will be determined. With reference to the volume of hydraulic fluid supplied to the hydraulic cylinder during the return stroke, it is possible to check the travel path determined in the preceding load stroke, thus avoiding malfunction in the control of a pressure source. Checking the travel path during the load stroke makes it possible to detect malfunction where the piston has been moved beyond the provided end position and against the end stop. Thus, the method of the invention is adapted to avoid that, without this being noticed, the control might stop the pressure source although the preset torque has not yet been impressed on the rotatable part.

A particularly preferred embodiment of the invention provides that the volume supplied to the hydraulic cylinder is determined on the basis of the temporal pressure development of the hydraulic pressure source. By calibration of the system, a pressure/volume-flow characteristic line can be determined so that, based on the temporal pressure development, the currently conveyed volumes can be added up to the total conveyed volume. Such a method according to the invention has the special advantage that no further sensor is requires for carrying out the method of the invention since a pressure sensor does already exist for the imparted torque. Particularly, no additional sensor is necessary on the piston-cylinder drive, with a resultant reduction of expenditure and vulnerability of the system. Additionally or alternatively, it can be provided that the volume supplied to the hydraulic cylinder during a load stroke is determined through volume flow measurement of the hydraulic fluid. A volume flow measurement can be performed, by use common volume flow measurement methods, e.g. in the hydraulic line between the piston-cylinder drive and the pressure source. In volume flow measurement, the volume supplied to the hydraulic cylinder can be determined in a simple manner.

It can be provided that the volume of hydraulic fluid supplied to the hydraulic cylinder during the return stroke is determined on the basis of a volume flow measurement of the hydraulic liquid or on the basis of the temporal development of the hydraulic pressure source.

According to an embodiment of the invention, it is provided that the end position of the piston is detected by a sensor. Using a sensor, the end position of the piston can be detected very precisely. The detection through a sensor can be performed—alternatively or additionally to the detection of the end position—based on the travel path of the piston. Even though the sensor on the piston-cylinder drive entails higher expenditure and higher vulnerability to external influences, it also results in a higher accuracy of the method of the invention. Depending on the respective type of rotatable part which the method of the invention is applied to, the provision of a sensor on the piston-cylinder drive can be advantageous.

The sensor can be an electronic sensor, an optical sensor or a Hall sensor. The sensor can be used e.g. a stop position sensor.

According to a preferred embodiment of the method of the invention, it is provided that the target value of the conveying volume of the pressure source for a return stroke is higher than the volume of hydraulic liquid required for a piston movement from the end position of a preceding load stroke to the starting position. Thereby, it can be safeguarded that, during the return stroke, the piston is moved to the starting position, thus avoiding malfunction in a subsequent load stroke. In this regard, the conveying volume of the pressure source for a return stroke can be preset in dependence on the volume that has really been supplied to the hydraulic cylinder during the preceding load stroke, or the volume to be supplied prior to a working cycle by calibration during a load stroke.

According to a particularly preferred embodiment of the method of the invention, it is provided that the end position of the piston is arranged at a distance D from the starting position of the piston that amounts to 85%-95%, preferably 90%, of the distance D between the starting position of the piston and the end stop. In other words, this is to say that the load stroke will amount to only to 85%-95% of the maximum stroke that can be performed with the piston-cylinder drive. In this manner, it is sufficiently ensured that the load stroke will be terminated without the piston abutting on the end stop, so that it can be safeguarded that the pressure of the pressure source that is determined at the end of the load stroke has really been imparted on the rotatable part.

When using a system comprising known system components, it is possible to preset known system properties in a control device of the pressure source. Thus, in case of known system components such as e.g. a known hydraulic line, and a known piston-cylinder drive, the corresponding volumes and a system behavior can already be set beforehand in the control device so that, for instance, pressure-dependent changes of the volume can be considered as correction volumes.

When using a system comprising at least one unknown system component, it is possible to detect system properties by calibration and to preset them in a control of the pressure source, wherein the system properties are detected by repeatedly performing maximum piston strokes without application of a load, and return strokes, said maximum piston strokes extending from the starting position of the piston until abutment of the piston on the end stop. In this manner, necessary system properties such as e.g. the volumes of the hydraulic lines and the volume of the piston-cylinder drive, and pressure-dependent changes of the volume caused by stretching of the hydraulic lines, can be determined and be considered in the control of the pressure source. Thereby, the method of the invention can be practiced in a particularly advantageous manner since a pressure source with control device can be used in different systems without the necessity of a bothersome adaptation of the control.

DESCRIPTION OF THE DRAWINGS

The method of the invention will be explained in greater detail hereunder with reference the accompanying drawings.

Therein, the following is shown.

RELATED DESCRIPTION OF PREFERRED EMBODIMENTS OF THE INVENTION

The method of the invention, provided for rotating a rotatable part by use of a hydraulic piston-cylinder drive operated by a hydraulic pressure source, can be performed e.g. in a power wrench for rotating a screw.

Figure 1:
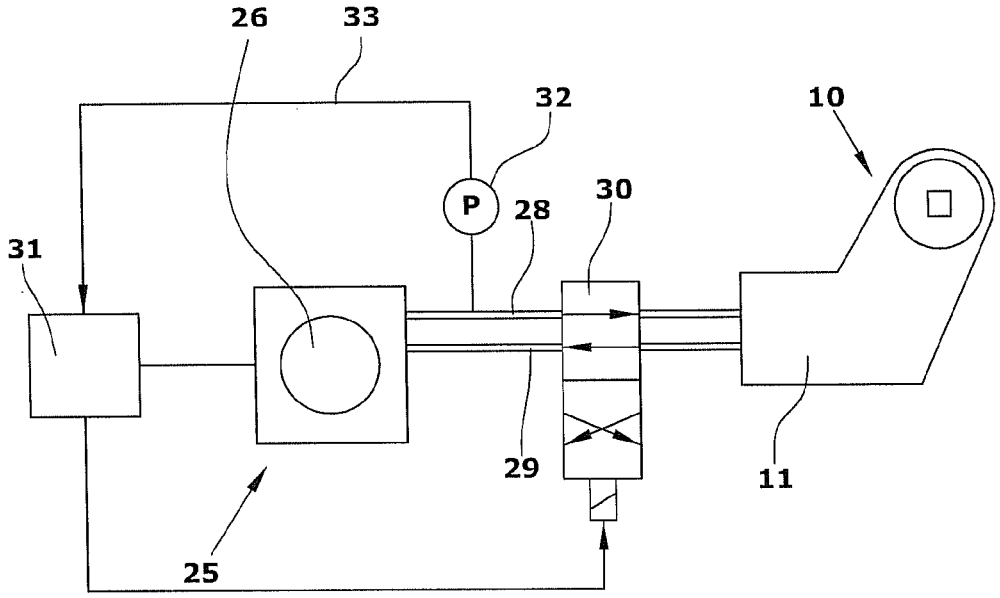
FIG. 1 is a schematic view of a screwing device comprising a hydraulic aggregate in a power wrench for rotating a screw.
Figure 2:
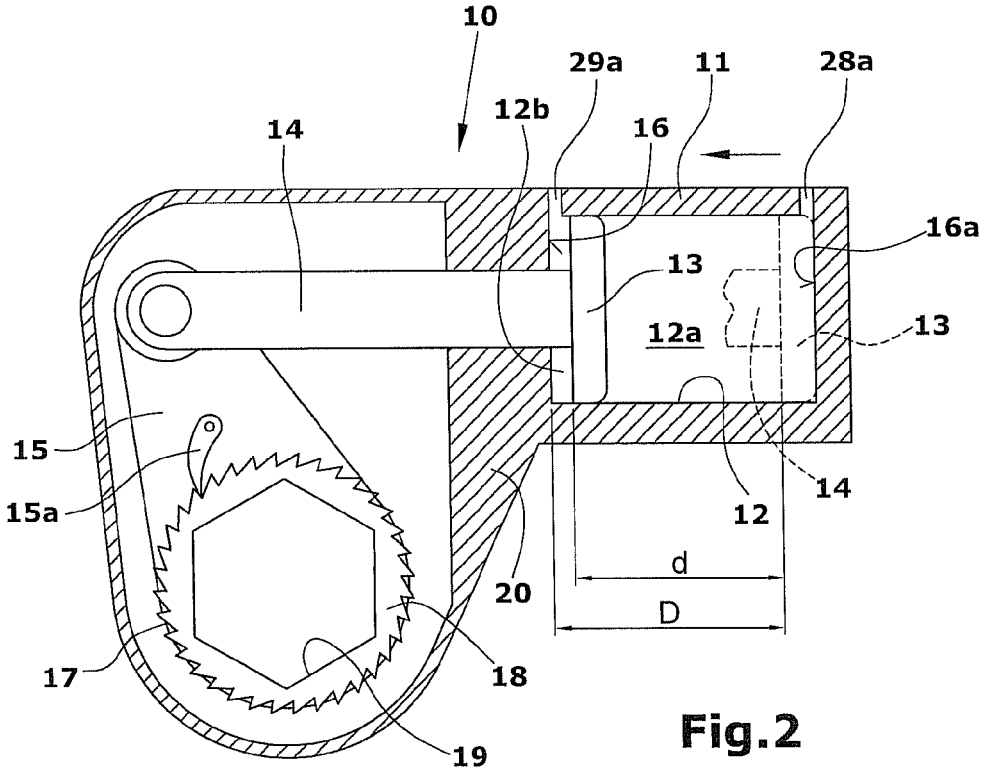
FIG. 2 is a schematic view of a power wrench including the piston-cylinder drive.

In FIG. 1 and FIG. 2, a power wrench 10 is schematically shown. The power wrench comprises a hydraulic piston-cylinder drive 11 including a hydraulic cylinder 12 and a piston 13 movably arranged in said cylinder. Piston 13 is connected to a piston rod 14, and the end of piston rod 14 engages a lever 15, the latter engaging a latch 15*a* on the toothing of a ratchet wheel 17. Ratchet wheel 17 is component part of a ring member 18 comprising a socket 19 for insertion of a key nut or of a screw head which is to be rotated. By reciprocating movement of piston 13, said ring member 18 and, together with it, the screw will be rotated. Ring member 18 is supported in a housing 20 which also includes said piston-cylinder drive 11.

The pressure for the piston-cylinder drive 11 is supplied by a pressure source 25 which in the embodiment shown in FIG. 1 is designed as a hydraulic aggregate. The hydraulic aggregate comprises a displacement pump 26 which includes a motor and a tank. Said pressure source 25 is connected to pressure line 28 and a return line 29. Said two lines are connected via a control valve 30 to the piston-cylinder drive 11. By switching the control valve 30, the piston 13 can be moved either in forward or rearward direction.

For control of pressure source 25 and control valve 30, a control device 31 is provided.

On pressure line 28, a pressure sensor 32 is provided for measuring the hydraulic pressure P in pressure line 28. Pressure sensor 32 is connected to control device 31 via a line 33.

During operation of power wrench 10, hydraulic fluid is supplied through pressure line 28 via an inlet 28*a* into a first chamber 12*a* of hydraulic cylinder 12. Thereby, piston 13 will be pressed in the direction toward an end stop 16. In the process, piston rod 14 exerts a force on lever 15 which will transform the force into a torque that will be imparted onto the rotatable part, e.g. a screw. The piston-cylinder drive 11 will thus perform a load stroke, the direction of the load stroke being represented by an arrow in FIG. 2. In case of a movement in the direction of the load stroke and a corresponding rotary movement of lever 15, the ratchet wheel 17 is locked so that the torque can be transmitted onto the rotatable part.

During the load stroke, the hydraulic fluid contained in the second chamber 12*b* located upstream of piston 13 as viewed in the load stroke direction will be forced via an outlet 29*a* into the return line 29.

When the piston 13 reaches an end position which is shown in FIG. 2, control device 31 will terminate the load stroke and start the return stroke. During the return stroke, hydraulic liquid is conducted through pressure line 28 via outlet 29*a* into the second chamber 12*b* so that the hydraulic liquid contained in the first chamber 12*a* will be forced by piston 13 via inlet 28*a* into the return line 29. In the process, piston 13 performs a movement opposite to the load stroke direction, while a pulling force is exerted on piston rod 14. During the return stroke, piston rod 14 will pull the lever 15 along with it, while the latch 15*a* is running free.

In the end position of piston 13 shown in FIG. 2, in which the load stroke is terminated and then the return stroke is initiated, the piston is in a position in which it has not yet abutted onto the end stop. In other words, the method of the invention provides that the piston 13 will not abut on end stop 16 during normal operation. Thereby, it is achieved that the hydraulic pressure P measured by the pressure sensor on pressure line 28 will be completely converted—under consideration of the usual correction values—into a torque to be exerted on the rotatable part. In other words, via the measured hydraulic pressure P, it is possible to detect the torque imparted on the rotatable part, while it is prevented the measured hydraulic pressure P is adulterated by abutment of piston 13 on end stop 16.

The end position of piston 13 can be determined by determining the current position of piston 13 on the basis of the travel path of the piston during the load stroke. When the end position is reached, the control device will then switch the control valve 30 for initiating the return stroke.

In the process, the travel path of piston 13 during the load stroke can be determined through the volume of hydraulic fluid supplied to hydraulic cylinder 12. The volume of hydraulic fluid supplied to hydraulic cylinder 12 can be determined e.g. on the basis of the temporal development of the pressure of the hydraulic pressure source 25, wherein the temporal development of the pressure of hydraulic pressure source 25 can be measured by pressure sensor 32. For this purpose, there is required a pressure/volume-flow characteristic line which is obtained from the calibration of the system so that the currently conveyed volumes determined from the current pressure can be added up to form the conveyed total volume. When the total volume which has been preset in advance has been reached, the control device 31 will detect that the piston 13 is located in its end position.

During the return stroke, it is possible, in order to check whether the piston 13 had been in the preset end position during the preceding load stroke, to measure also the volume of hydraulic fluid supplied to the second chamber 12*b*. Also in determining the volume of hydraulic liquid during the return stroke, use can be made of the temporal development of the pressure of the hydraulic pressure source 25.

Of course, it is also possible to determine the volume of a hydraulic fluid supplied to hydraulic cylinder 12 through volume flow measurement.

In the method of the invention, it can also be provided that the end position of the piston is detected by means of a sensor which is used e.g. as an end position sensor. Via said sensor, control device 31 will receive a signal for termination of the load stroke and initiation of the return stroke. Alternatively or additionally, said sensor can be used for determining the end position on the basis of the travel path of piston 13.

When using the method of the invention with a power wrench which is not provided with a sensor for detecting the end position of piston 13, it is advantageous if it can be safeguarded that, prior to the begin of a load stroke, the piston 13 is in a starting position where it is in abutment on a second end stop 16*a*. In FIG. 2, the piston in its starting position is schematically represented by interrupted lines. Thus, it can be safeguarded that no residual volume of hydraulic fluid exists in the first chamber 12*a*. A residual volume of hydraulic fluid would have the consequence that, in the process of supplying a predetermined volume, the piston 13 would be moved beyond the end position. In order to ensure that the piston 13 is in the starting position at the end of the return stroke and the beginning of the load stroke, it can be provided that, during the return stroke, the preset value of the volume of hydraulic fluid supplied to the hydraulic cylinder 12 is larger than the volume supplied to the hydraulic cylinder during the preceding load stroke, which is effected in that the preset value of the conveying volume of the pressure source 25 during the return stroke is set correspondingly higher than during the load stroke. In its end position, piston 13 is located at a distance d from the starting position of piston 13 that is 85%-95% of the distance D between the starting position of piston 13 and the end stop 16. In other words, the load stroke will amount to only 85%-95% of the maximal stroke to be performed by the piston-cylinder drive 11. The maximal stroke of hydraulic cylinder 12 is a stroke from the starting position of piston 13 until piston 13 hits onto end stop 16.

The avoidance of an abutment of piston 13 on end stop 16 also has the advantage that the piston-cylinder drive 11 is subjected to a smaller mechanical stress. Since high pressures are generated during the load stroke, the hitting impact of piston 13 onto end stop 16 would cause a high mechanical stress of piston 13, which is avoided by the method of the invention. During the return stroke, such high mechanical stresses will occur on piston 13 when the piston hits onto the second end stop 16*a*.

If the method of the invention is used with a system which consists exclusively of known system component, such as e.g. a known power wrench comprising a known hydraulic piston-cylinder drive 11 as well as a known pressure line 28 and a known return line 29, the known system properties can be preset for the control of pressure source 25. For instance, these properties can already have been stored in control device 31. The system properties can be e.g. pressure-dependent volume changes of the lines.

When using a system including at least one unknown system component, the system properties can be detected by calibration and be considered in a corresponding manner in the control of the pressure source 25. In this case, the system properties will be detected by performing multiple maximum piston strokes without application of a load, and return strokes.

The invention claimed is:

1. A method for rotating a rotatable part by use of a hydraulic piston-cylinder drive operated by a hydraulic pressure source and having at least one piston as well as a hydraulic cylinder and a ratchet, comprising:

applying a torque to the rotatable part during a loading stroke and moving the piston into a starting position via a return stroke;

terminating the loading stroke when an end position of the piston is reached; and subsequently starting the return stroke;

wherein the end position is a position of the piston before abutment of the piston against an end stop, wherein a current position of the piston is determined on the basis of the travel path of the piston during the load stroke, wherein the travel path of the piston during the load stroke is determined on the basis of a volume of the hydraulic fluid supplied to the hydraulic cylinder such that the current position is determined at any point along the travel path of the piston.

2. The method according to claim 1, wherein the volume of hydraulic fluid supplied to the hydraulic cylinder during the return stroke is determined.

3. The method according to claim 2, wherein the volume of hydraulic fluid supplied to the hydraulic cylinder during the return stroke is determined on the basis of a volume flow measurement of the hydraulic liquid or on the basis of the temporal development of the hydraulic pressure source.

4. The method according to claim 1, wherein the volume supplied to the hydraulic cylinder is determined on the basis of the temporal pressure development of the hydraulic pressure source.

5. The method according to claim 1, wherein the volume supplied to the hydraulic cylinder during the load stroke is determined on the basis of a volume flow measurement of the hydraulic liquid.

6. The method according to claim 1, wherein the end position of the piston is detected by a sensor.

7. The method according to claim 6, wherein said sensor is used as an end position sensor.

8. The method according to claim 1, including using said sensor as an electronic sensor, an optical sensor or a Hall sensor.

9. The method according to claim 1, wherein a target value of a conveying volume of the hydraulic pressure source for a return stroke is higher than the volume of hydraulic liquid required for a piston movement from the end position of a preceding load stroke to the starting position.

10. The method according to any claim 1, wherein the end position of the piston is arranged at a distance from the starting position of the piston that amounts to 85%-95% of the distance between the starting position of the piston and the end stop.

* * * * *